US011830641B2

(12) United States Patent
Cho et al.

(10) Patent No.: US 11,830,641 B2
(45) Date of Patent: Nov. 28, 2023

(54) CHIP RESISTOR COMPONENT

(71) Applicant: SAMSUNG ELECTRO-MECHANICS CO., LTD., Suwon-si (KR)

(72) Inventors: Ah Ra Cho, Suwon-si (KR); Kwang Hyun Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 17/545,270

(22) Filed: Dec. 8, 2021

(65) Prior Publication Data

US 2022/0270790 A1 Aug. 25, 2022

(30) Foreign Application Priority Data

Feb. 25, 2021 (KR) ..... 10-2021-0025354

(51) Int. Cl.
*H01C 1/142* (2006.01)
*H01C 7/12* (2006.01)
*H01C 7/00* (2006.01)

(52) U.S. Cl.
CPC ..... *H01C 1/142* (2013.01); *H01C 7/003* (2013.01); *H01C 7/12* (2013.01)

(58) Field of Classification Search
CPC ..... H01C 17/242; H01C 7/12; H01C 7/003; H01C 1/142
See application file for complete search history.

(56) References Cited

U.S. PATENT DOCUMENTS 6,492,896 B2 * 12/2002 Yoneda ..... H01C 7/003 338/195
7,782,174 B2 * 8/2010 Urano ..... H01C 1/142 338/307
7,786,842 B2 * 8/2010 Tsukada ..... H01C 7/003 338/332
8,193,899 B2 * 6/2012 Takeuchi ..... H01C 17/006 338/262
9,035,740 B2 * 5/2015 Washizaki ..... H01H 69/022 337/159

(Continued)

FOREIGN PATENT DOCUMENTS

KR 10-2001-0107249 A 12/2001
KR 10-2006-0069350 A 6/2006

*Primary Examiner* — Kyung S Lee
(74) *Attorney, Agent, or Firm* — Morgan, Lewis & Bockius LLP

(57) ABSTRACT

A chip resistor component, includes: a substrate having one surface, and one side surface and the other side surface facing each other in one direction; an terminal including an internal electrode disposed on the one surface, and an external electrode disposed on the one side surface to be connected to the internal electrode; a resistive layer disposed on the one surface, and including an outermost pattern connected to the internal electrode; and a protective layer disposed on the one surface to cover the resistive layer. The outermost pattern of the resistive layer has a first region in contact with the internal electrode and a second region extending, in the one direction, from the first region towards the other side surface. A ratio of a length of the second region in the one direction to a length of the chip resistor component in the one direction is 0.02 or more.

20 Claims, 3 Drawing Sheets

(56) References Cited

U.S. PATENT DOCUMENTS

| | | | | |
|---|---|---|---|---|
| 9,704,621 | B2 * | 7/2017 | Ogawa | H01C 7/003 |
| 9,997,281 | B2 * | 6/2018 | Shinoura | H01C 17/006 |
| 10,832,837 | B2 * | 11/2020 | Shinoura | H01C 17/02 |
| 10,937,573 | B2 * | 3/2021 | Shinoura | H01C 1/142 |
| 10,964,461 | B1 * | 3/2021 | Shin | H01C 17/006 |
| 2007/0035379 | A1 | 2/2007 | Yoneda | |
| 2016/0247610 | A1 * | 8/2016 | Shinoura | H01C 1/142 |

* cited by examiner

CHIP RESISTOR COMPONENT

CROSS-REFERENCE TO RELATED APPLICATION

This application claims benefit of priority to Korean Patent Application No. 10-2021-0025354, filed on Feb. 25, 2021 in the Korean Intellectual Property Office, the disclosure of which is incorporated herein by reference in its entirety.

TECHNICAL FIELD

The present disclosure relates to a chip resistor component.

BACKGROUND

In order to cope with the recent trend for weight reductions and miniaturization of mobile devices, the need to implement light, thin, and compact electronic components mounted on circuit boards is also increasing.

As the power demand of electronic devices increases and demand for chip resistor components for overcurrent detection in circuits and chip resistor parts for residual amount detection increase, a chip resistor component having a low resistance value with high precision and reliability is required.

SUMMARY

An aspect of the present disclosure is to provide a chip resistor component being miniaturized, high power and high reliability.

Another aspect of the present disclosure is to provide a chip resistor component capable of improving electrostatic discharge (ESD) characteristics while being miniaturized.

According to an aspect of the preset disclosure, in a chip resistor component, the chip resistor component includes: a substrate having one surface, and one side surface and the other side surface respectively connected to the one surface and facing each other in one direction; a first terminal including a first internal electrode disposed on the one surface of the substrate, and a first external electrode disposed on the one side surface of the substrate to be connected to the first internal electrode; a resistive layer disposed on the one surface of the substrate, and including an outermost pattern connected to the first internal electrode; and a protective layer disposed on the one surface of the substrate to cover the resistive layer. The outermost pattern of the resistive layer has a first region in contact with the first internal electrode, and a second region extending, in the one direction, from the first region towards the other side surface. A ratio of a length of the second region in the one direction to a length of the chip resistor component in the one direction is 0.02 or more.

According to an aspect of the preset disclosure, in a chip resistor component, the chip resistor component includes: a substrate having one surface, and one side surface and the other side surface respectively connected to the one surface and facing each other in one direction; a first terminal including a first internal electrode disposed on the one surface of the substrate, and a first external electrode disposed on the one side surface of the substrate to be connected to the first internal electrode; a resistive layer disposed on the one surface of the substrate, and including an outermost pattern connected to the first internal electrode; and a protective layer disposed on the one surface of the substrate to cover the resistive layer. The outermost pattern of the resistive layer has a first region in contact with the first internal electrode, and a second region extending, in the one direction, from the first region towards the other side surface. The second region in the one direction has a length of 20 μm or more.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
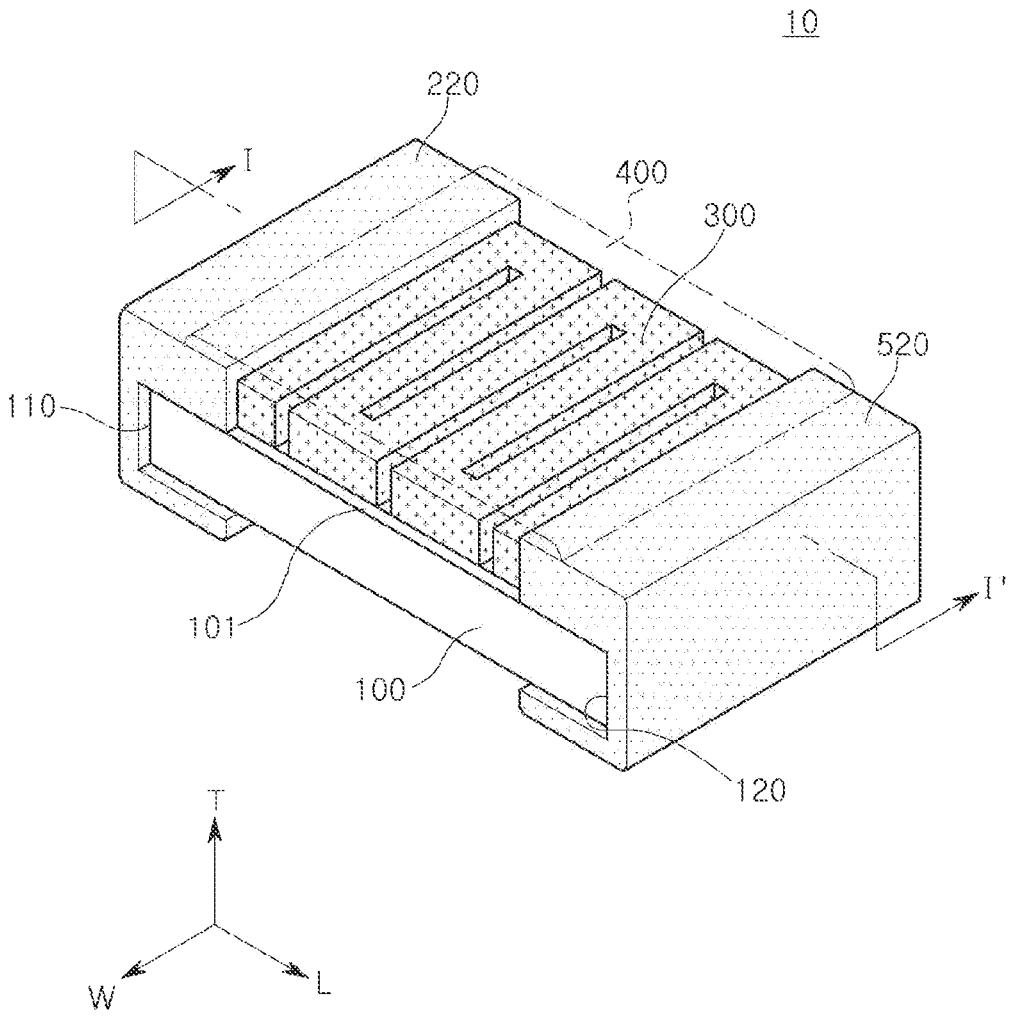
FIG. 1 is a diagram schematically illustrating a chip resistor component according to the present disclosure.

Hereinafter, the present disclosure will be described with reference to the accompanying drawings. Shapes and dimensions of the elements in the drawings may be exaggerated or reduced for greater clarity of description.

In addition, in adding reference numerals to the components of the accompanying drawings, only the same components are to have the same reference numerals, even if they are provided in different drawings.

In the following description of the present disclosure, if it is determined that the detailed description of the related known technology may obscure the gist of the present disclosure, the detailed description thereof will be omitted.

In the drawings, an L direction may be defined as one direction or a length direction, a W direction may be defined as a width direction, and a T direction may be defined as a thickness direction.

Chip Resistor Component

FIG. 1 is a diagram schematically illustrating a chip resistor component according to the present disclosure.

Referring to FIG. 1, a chip resistor component 10 may include a substrate 100, a first external electrode 220, a second external electrode 520, a resistive layer 300, and a protective layer 400, but an embodiment of the present disclosure is not limited thereto.

The substrate 100 may form an exterior of the chip resistor component 10 according to the present disclosure, support the resistive layer 300, and secure the strength of the chip resistor component 10. The substrate 100 includes one surface 101, and one side surface 110 and the other side surface 120 respectively connected to the one surface 101 and facing each other in one direction L.

The substrate 100 may provide a space for mounting an electrode and a resistor. For example, the substrate 100 may be an insulating substrate made of a ceramic material. The ceramic material may be alumina ($Al_2O_3$), but is not particularly limited as long as it is a material excellent in insulation, heat dissipation, and adhesion to a resistor.

The substrate 100 may have a predetermined thickness and may have a rectangular parallelepiped shape. In this case, the shape of any one of six surfaces thereof may be configured as a thin plate, and the surface may be anodized and may be formed of an insulated alumina ($Al_2O_3$) material.

In addition, since the substrate 100 is formed of a material having excellent thermal conductivity, the substrate 100 may serve as a heat diffusion path for dissipating heat generated in the resistive layer 300 externally when a chip resistor component is used.

A first external electrode 220 may be disposed on one side surface 110 of the substrate 100, and a second external electrode 520 may be disposed on the other side surface 120 facing the one side surface 110.

A resistive layer 300 connected to an internal electrode disposed inside a chip resistor component may be disposed on one surface 101 of the substrate, and the resistive layer 300 may include an outermost pattern 310 as will be described later. In addition, the resistive layer 300 may be connected to an internal electrode and an external electrode to form a predetermined resistance between the first and second external electrodes 220 and 520.

Figure 2:
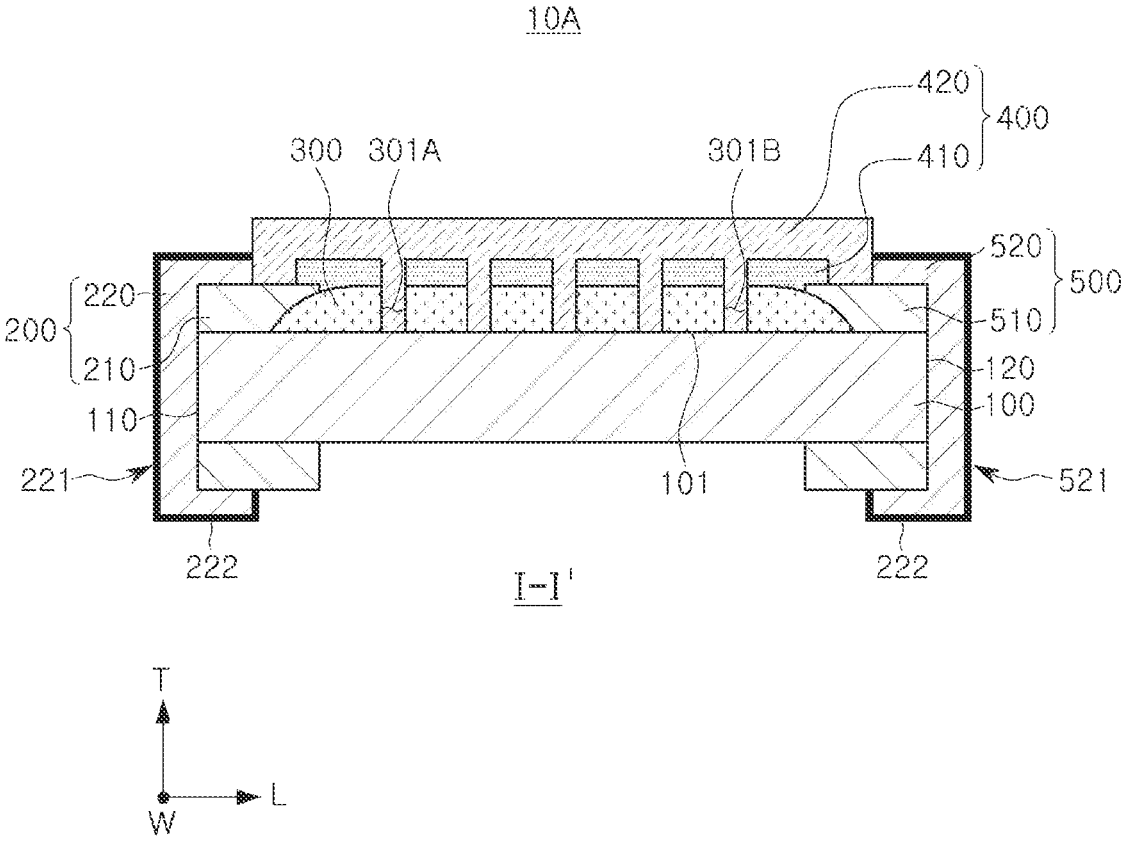
FIG. 2 is a view illustrating a cross-section taken along line I-I' of FIG. 1.
Figure 3:
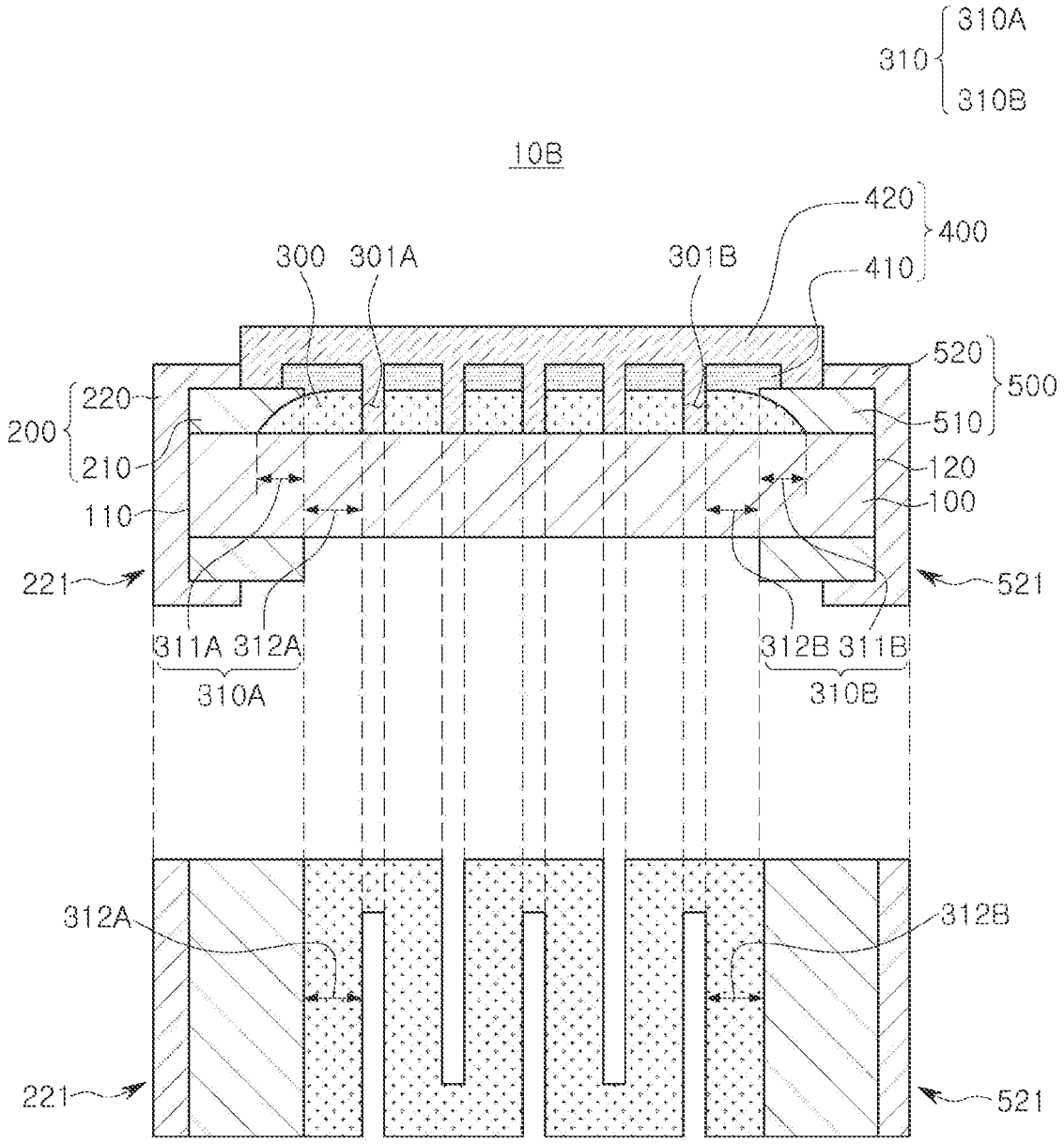
FIG. 3 is a diagram schematically illustrating a cross-sectional view of a chip resistor component according to the present disclosure.

Similar to examples shown in FIGS. 2 and 3, the outermost pattern 310 may have first regions 311A and 311B and second regions 312A and 312B. The first regions 311A and 311B may be in contact with the first and second internal electrodes 210 and 510. The second region 312A may extend towards the second internal electrode 510 from the first region 311A at an interface between the first region 311A and the first internal electrode 210. The second region 312B may extend towards the first internal electrode 210 from the first region 311B at an interface between the first region 311B and the second internal electrode 510. In one example, the second regions 312A and 312B may not be in contact with the internal electrodes.

In this case, a ratio of the length in one direction L of the second regions 312A and 312B to the length of the chip resistor component 10 in one direction L of the chip resistor component 10 may be 0.02 or more, but is not limited thereto.

In addition, the length of the second regions 312A and 312B in the one direction L may be 20 μm or more, but is not limited thereto.

The resistive layer 300 may include a fine pattern by a technique such as laser patterning, or the like, and grooves or holes in the patterned resistive layer 300 may be filled with a protective layer 400.

In this case, in order to form the outermost pattern 310 to have a longer length, a groove or a hole, closest to each of the first and second internal electrodes 210 and 510 among the grooves of the patterned resistive layer 300, may be formed to have a length greater than or equal to a predetermined length from each of outermost side surfaces of external electrodes.

The first regions 311A and 311B of the outermost pattern in contact with the internal electrode may correspond to a portion of the resistive layer 300 having a reduced thickness. That is, the length of the first region of the outermost pattern in contact with the internal electrode in a thickness (T) direction may gradually become thinner as it approaches one side surface 110 and the other side surface 120 of the substrate 100.

In this case, if a technique such as laser patterning, or the like, is applied to a position of the first region in which the thickness of the resistive layer 300 is reduced, resistance characteristics may be deteriorated. That is, in order to apply the laser patterning method to a chip resistor component being miniaturized, there may be insufficient space for patterning.

In addition, since electrostatic discharge (ESD) characteristics and power characteristics are affected by a size of the resistive layer, as the size of the chip resistor component decreases, electrical characteristics of the chip may be deteriorated.

In order to prevent this, among the outermost patterns 310A and 310B of the resistive layer 300, a length of the second regions 312A and 312B not in contact with the internal electrodes of the outermost patterns 310A and 310B of the resistive layer 300 in the one direction L may be formed to be longer than a predetermined length.

Specifically, the length of the second regions 312A and 312B of the outermost pattern in the one direction L may be 20 μm or more, but is not limited thereto. In one example, the length of one of the second regions 312A and 312B of the outermost pattern in the one direction L may be 20 μm or more.

In addition, the length of the second regions 312A and 312B of the outermost pattern in the one direction may be 0.02 times or more of the length of the chip resistor component 10 in the one direction, but is not limited thereto. In one example, the length of one of the second regions 312A and 312B of the outermost pattern in the one direction may be 0.02 times or more of the length of the chip resistor component 10 in the one direction.

As described above, when the length of the outermost layer pattern 310 of the resistive layer 300 is formed to be relatively long and a pattern of the resistive layer 300 is realized by laser patterning, electrostatic discharge (ESD) characteristics in a small-sized chip resistor component can be improved, and enhanced power characteristics can be realized.

In addition, by applying laser patterning to the resistive layer 300 as described above, a length of a resistor in the one direction L can be extended within a limited area of the resistive layer 300, thereby reducing a voltage applied per unit length. Thereby, the ESD characteristics in the small-sized resistor component may also be improved.

The resistive layer 300 may include Ag, Pd, Cu, Ni, Cu—Ni-based alloy, Ni—Cr-based alloy, Ru oxide, Si oxide, Mn and Mn-based alloy, or the like, as a main component, and may include various materials depending on the required resistance value.

Specifically, the resistive layer 300 may contain more metal made of silver (Ag), palladium (Pd), or alloys thereof in a low resistance region, and may include more glass or $RuO_2$ in a high resistance region.

In particular, the resistive layer 300 may include at least one of a glass component and a metal component. In this case, when a large amount of a glass component is included and a small amount of a metal component is included, the chip resistor component may have a high resistance value, and when a small amount of the glass component is included and a large amount of the metal component is included, the chip resistor component may have a low resistance value.

Through the laser patterning process of the resistive layer 300, a material having a high metal component and a low glass component can be formed, so that a chip resistor component having low resistance can be realized and a degree of insulation breakdown can be reduced. As a result, internal voltage characteristics can be improved to improve the ESD characteristic within the component, and the power characteristics can also be improved.

The resistance value of the resistive layer 300 may vary depending on a temperature of the resistive layer 300. The temperature characteristic of the resistive layer 300 may be expressed as a temperature coefficient of resistivity (TCR), which is a rate of change of a resistance value according to a change in temperature. As an absolute value of the temperature coefficient of resistivity decreases, the resistive layer 300 may have characteristics more robust to the change in temperature.

The protective layer 400 may be disposed on one surface 101 of the substrate to cover the resistive layer 300, and the protective layer 400 may include a plurality of layers.

FIG. 2 is a view illustrating a cross-section taken along line I-I' of FIG. 1.

Referring to FIG. 2, a chip resistor component 10A includes a first terminal 200 including a first internal electrode 210 disposed on one surface 101 of a substrate 100, and a first external electrode 220 disposed on one side surface 110 of the substrate 100 to be connected to the first internal electrode 210.

The first external electrode 220 may be connected to all or a part of the first internal electrode 210.

In addition, the chip resistor component 10A may further include a second terminal 500 including a second internal electrode 510 disposed to be spaced apart from the first internal electrode 210 disposed on the one surface 101 of the substrate 100, and a second external electrode 520 disposed on the other side surface 120 of the substrate 100 to be connected to the second internal electrode 510.

The second external electrode 520 may be connected to all or a part of the second internal electrode 510.

The first and second external electrodes 220 and 520 may be disposed to cover the one side surface 110 and the other side surface 120 of the substrate 100, respectively. Referring to FIG. 2, the first and second external electrodes 220 and 520 are disposed to be spaced apart from each other in a longitudinal (L) direction of the substrate 100 with the resistive layer 300 interposed therebetween.

The first and second external electrodes 220 and 520 may further include a plating layer 221 and a plating layer 521, respectively.

The plating layers 221 and 521 may be electrically connected to a solder, a connecting conductor. In this case, the plating layers 221 and 521 may include at least one of nickel (Ni) and tin (Sn), and may have a structure in which a nickel (Ni) plating layer and a tin (Sn) plating layer are sequentially stacked.

In addition, the protective layer 400 may include a first protective layer 410 and a second protective layer 420.

Among the protective layers 400, the first protective layer 410 adjacent to the resistive layer 300 may be formed to cover a portion of the resistive layer 300 and the internal electrodes 210 and 510, but the protective layer 410 may not extend to the one side surface 110 and the other side surface 120 of the substrate 100.

In addition, the first protective layer 410 may include silicon dioxide ($SiO_2$) or bismuth (Bi), and a material thereof is not limited, but may include glass to protect the resistive layer in a process such as laser patterning, or the like, of the resistive layer 300.

The second protective layer 420 adjacent to the first protective layer 410 may be formed by applying a paste. The protective layer 400 may include a plurality of layers, and may include at least one of a polymer such as epoxy, a phenol resin, and the like, and glass. In particular, the first protective layer 410 may include a glass component, and the second protective layer 420 may include a resin component.

Although not specifically illustrated, a laser patterning process of the resistive layer 300 may be performed after the formation of the first protective layer 410. A resistance value may be determined by laser patterning of the resistive layer 300.

Similar to the example shown in FIG. 3, during the laser patterning, a length of the second regions 312A and 312B in the one direction L among the outermost patterns 310 of the resistive layer 300 may be formed to be long in the one direction.

Specifically, the length of the second regions 312A and 312B of the outermost layer pattern in the one direction may be 20 μm or more, but is not limited thereto.

In addition, the length of the second regions 312A and 312B of the outermost layer pattern in the one direction may be 0.02 times or more of the length of the chip resistor component 10 in the one direction, but is not limited thereto.

When the length of the outermost pattern 310 is long as described above, even if a thickness of the first regions 311A and 311B of an outermost pattern of the resistive layer is thin, that is, the length of the first regions 311A and 311B in a thickness (T) direction is short, a sufficient path for a current to flow in the resistive layer 300 may be secured through the second region, so that ESD characteristics may be improved, and high power characteristics can be realized.

When a pattern of the resistive layer 300 by laser patterning so that the length of the outermost pattern 310 of the resistive layer 300 is formed to have a long length as described above, electrostatic discharge (ESD) characteristics in the small-sized chip resistor component may be improved, and enhanced power characteristics can be realized.

In addition, by applying laser patterning to the resistive layer 300 as described above, a length of a resistor in the one direction L can be realized to be long within a limited area of the resistive layer 300, thereby lowering a voltage applied per unit length. Thereby, the ESD characteristics in the small-sized resistor component may also be improved.

The second protective layer 420 may include one surface in contact with the first protective layer 410, and the second protective layer 420 may be formed to extend so that a portion of the one surface of the second protective layer passes through each of the first protective layer 410 and the resistive layer 300, and may be formed to cover grooves or holes of the patterned resistive layer 300.

Descriptions of other components are substantially the same as those described above, and detailed descriptions thereof will be omitted.

FIG. 3 is a diagram schematically illustrating a cross-sectional view of a chip resistor component according to the present disclosure.

Referring to FIG. 3, a resistive layer 300 of a chip resistor component 10B according to the present disclosure may include an outermost pattern 310.

It may be formed by processing the resistive layer 300 of the outermost pattern 310 by a technique such as laser patterning, and a pattern from a groove or hole closest to each of the one side surface 110 and the other side surface 120 of the substrate 100 to an outermost portion of the resistive layer 300 among grooves or holes of the resistive layer 300, may correspond to the outermost pattern 310.

The outermost pattern 310 may include a first outermost pattern 310A including a first region 311A in contact with the first internal electrode 210 and a second region 312A not in contact with the first internal electrode, and a second outermost pattern 310B including a first region 311B in contact with a second internal electrode and a second region 312B not in contact with the second internal electrode.

Referring to FIG. 3, a ratio of a length of the second regions 312A and 312B in one direction L to the length of the chip resistor component 10B in one direction L may be 0.02 or more, but is not limited thereto.

In addition, the length of the second regions 312A and 312B in the one direction may be 20 μm or more, but is not limited thereto.

When the length of the second regions 312A and 312B are formed to be long as described above, even if the thickness of the first region of the outermost pattern 310 of the resistive layer 300 is thin, that is, the length of the first region in a thickness (T) direction is short, a sufficient path for a current to flow in the resistive layer 300 may be secured through the second region, so that ESD characteristics may be improved, and high power characteristics can be realized.

The ratio of the second regions 312A and 312B of the outermost pattern to the length of the chip resistor component 10B in the one direction L described above is calculated as a ratio of a length measurement value of the chip resistor component 10B in one direction L and a length measurement value of the second regions 312A and 312B in one direction L.

The length measurement value may mean an average value of lengths measured a plurality of times by changing positions of the chip resistor component 10B in a width direction W, and the average value means an arithmetic average value of the lengths measured a plurality of times, but is not limited thereto.

The length measurement value of the chip resistor component 10B is derived as follows.

A length measurement value of a chip resistor component 10B means a value obtained by measuring an entire length of the chip resistor component 10B in one direction L. That is, the length measurement value thereof can be derived by measuring both outermost ends of the chip resistor component 10B in the one direction L.

The length measurement value may mean an average value of the lengths measured a plurality of times by changing positions of the chip resistor component 10 in a width direction W, and the average value may mean an arithmetic average value of the lengths measured a plurality of times. However, it is not limited thereto.

A length measurement value of the second regions 312A and 312B are derived as follows.

The length measurement values of the second regions 312A and 312B correspond to a length measurement value excluding the first regions 311A and 311B of the outermost patterns 310. Accordingly, a value obtained by subtracting the length measurement value of the first regions 311A and 311B from the length measurement value of the outermost pattern 310 corresponds to the length measurement value of the second regions 312A and 312B.

A length measurement value of the outermost pattern means a measurement value from both ends of the resistive layer 300, which is a starting point, to distances 310A and 310B of first patterned grooves 301A and 301B in one direction L of the chip resistor component 10B.

The length measurement value may mean an average value of lengths measured a plurality of times by changing a position of a chip resistor component 10B in a width direction W, and the average value may mean an arithmetic average value of the lengths measured a plurality of times. However, it is not limited thereto.

The length measurement value of the first regions 311A and 311B is obtained by projecting a portion of the resistive layer 300 in contact with the first and second internal electrodes 210 and 510 in a thickness (T) direction of the chip resistor component 10, and corresponds to a value measured by a length of both ends of the chip resistor component 10 in one direction L.

The length measurement value may mean an average value of the lengths measured a plurality of times by changing a position of the chip resistor component 10B in a width direction W, and the average value may mean an arithmetic average value of the lengths measured a plurality of times. However, it is not limited thereto.

Descriptions of other components are substantially the same as those described above, and detailed descriptions thereof will be omitted.

Resistance characteristics of the chip resistor component 10B according to the length of the second regions 312A and 312B may be evaluated as follows.

First, after measuring a resistance value (an initial value) before an experiment, a voltage is applied for 5 seconds. A resistance value (a latter value) after a voltage is applied is measured to calculate a resistance value change rate. The applied voltage is increased until the resistance value change rate becomes ±1% or more (NG generation).

The resistance value change rate is calculated as (a latter value−an initial value)/an initial value×100.

Thereafter, an evaluation process of the resistance characteristics is repeated while changing the length of the second regions 312A and 312B.

Results according to the evaluation process are derived as follows.

When a ratio of the length of the second regions 312A and 312B to the length of the chip resistor component 10B in one direction L is 0.02, even when a high voltage (2.5 Vr or more) is applied, a resistance value change rate is maintained to be less than ±1%.

In addition, as the ratio of the lengths of the second regions 312A and 312B to the length of the chip resistor component 10B in the one direction L is greater than 0.02, it can be confirmed that the resistance value change rate is maintained to be less than ±1% even when a higher voltage is applied.

However, when the ratio of the length of the second regions 312A and 312B to the length of the chip resistor component 10 in the one direction L is less than 0.02, when a high voltage (2.5 Vr or more) is applied, the resistance characteristic may be deteriorated. That is, the resistance value change rate may exceed 1%.

TABLE 1

| Second region | | | | | | | | |
|---|---|---|---|---|---|---|---|---|
| Length | Second region/ Chip resistor | Applied voltage | | | | | | |
| (um) | component | 1.0Vr | 1.5Vr | 2.0Vr | 2.5Vr | 3.0Vr | 3.5Vr | 4.0Vr |
| 15 | 0.015 | 0.00 | −0.04 | −0.35 | −1.56 | −3.80 | 3.58 | 6.85 |
| 20 | 0.020 | −0.01 | −0.05 | −0.20 | −0.72 | −2.73 | −1.59 | 2.68 |
| 50 | 0.050 | 0.00 | −0.04 | −0.11 | −0.49 | −1.55 | 0.58 | 2.48 |
| 90 | 0.090 | −0.01 | −0.02 | −0.05 | −0.35 | −0.47 | 4.03 | 5.87 |

For example, when the ratio of the length of the second regions 312A and 312B to the length of the chip resistor component 10 in the one direction L is 0.015, when the applied voltage is increased from 2.0 Vr to 2.5 Vr, a resistance value change rate may exceed 1%.

Through the above-described evaluation method, when the length of the second regions 312A and 312B is 0.02 times or more of the length of the chip resistor component 10, it can be confirmed that the chip resistor component operates normally even when a high voltage of 2.5 Vr or more is applied.

As a result of another evaluation process, when the length of the second regions 312A and 312B is 20 μm, even when a high voltage (2.5 Vr or more) is applied, the resistance value change rate may be maintained to be less than ±1%.

In addition, as the length of the second regions 312A and 312B is greater than 20 μm, it can be seen that the resistance value change rate is maintained to be less than ±1% even when a higher voltage (2.5 Vr or more) is applied.

However, when the length of the second regions 312A and 312B is less than 20 μm, resistance characteristics may be deteriorated when a high voltage (2.5 Vr or more) is applied. That is, the resistance value change rate may exceed 1%.

For example, when the length of the second regions 312A and 312B is 15 μm, when the applied voltage is increased from 2.0 Vr to 2.5 Vr, the resistance value change rate may exceed 1%.

Through the above-described evaluation method, when the length of the second regions 312A and 312B, not in contact with internal electrodes, among the outermost patterns 310 of the resistive layer 300, is 20 μm or more, even when a high voltage of a high voltage of 2.5 Vr or more is applied, it can be confirmed that the chip resistor component operates normally.

As set forth above, as one effect among various effects of the present disclosure, a chip resistor component having a small-size, high-power and high-reliability may be provided.

As another effect among various effects of the present disclosure, a chip resistor component capable of improving electrostatic discharge (ESD) characteristics while being small sized may be provided.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be construed as being limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both upward and downward orientations, depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

While exemplary embodiments have been shown and described above, it will be apparent to those skilled in the art that modifications and variations could be made without departing from the scope of the present invention as defined by the appended claims.

What is claimed is:

1. A chip resistor component, comprising:

a substrate having one surface, and one side surface and the other side surface respectively connected to the one surface and facing each other in one direction;

a first terminal including a first internal electrode disposed on the one surface of the substrate, and a first external electrode disposed on the one side surface of the substrate to be connected to the first internal electrode;

a resistive layer disposed on the one surface of the substrate and including patterns and grooves arranged alternately in the one direction, a first outermost pattern among the patterns of the resistive layer being connected to the first internal electrode; and a protective layer disposed on the one surface of the substrate to cover the resistive layer, wherein the first outermost pattern of the resistive layer has a first region in contact with the first internal electrode, and a second region extending, in the one direction, from the first region to one groove which is closest to the first internal electrode among the grooves, wherein the first region is disposed between the substrate and the first internal electrode, wherein a ratio of a length of the second region in the one direction to a length of the chip resistor component in the one direction is 0.02 or more, and wherein a thickness of the second region of the resistive layer is equal to or greater than a thickness of the first internal electrode.

2. The chip resistor component of claim 1, wherein the second region in the one direction has the length of 20 μm or more.

3. The chip resistor component of claim 1, wherein the protective layer comprises a first protective layer and a second protective layer.

4. The chip resistor component of claim 3, wherein the first protective layer comprises a glass component.

5. The chip resistor component of claim 3, wherein the second protective layer comprises a resin component.

6. The chip resistor component of claim 3, wherein the second protective layer comprises one surface in contact with the first protective layer, and a portion of one surface of the second protective layer extends to penetrate through each of the first protective layer and the resistive layer.

7. The chip resistor component of claim 3, wherein the second protective layer includes portions respectively disposed in grooves in the first protective layer and the grooves in the resistive layer.

8. The chip resistor component of claim 1, wherein the first external electrode comprises a plating layer.

9. The chip resistor component of claim 8, wherein the plating layer comprises at least one of nickel (Ni) and tin (Sn).

10. The chip resistor component of claim 1, further comprising, a second internal electrode disposed on the one surface of the substrate to be spaced apart from the first internal electrode, and a second external electrode disposed on the other side surface of the substrate to be connected to the second internal electrode.

11. The chip resistor component of claim 10, wherein a second outermost pattern among the patterns of the resistive layer is connected to the second internal electrode.

12. The chip resistor component of claim 1, wherein a thickness of the first region is reduced in the one direction towards the one side surface.

13. The chip resistor component of claim 1, wherein a thickness of the first region is less than a thickness of the second region.

14. A chip resistor component, comprising:

a substrate having one surface, and one side surface and the other side surface respectively connected to the one surface and facing each other in one direction;

a first terminal including a first internal electrode disposed on the one surface of the substrate, and a first external electrode disposed on the one side surface of the substrate to be connected to the first internal electrode;

a resistive layer disposed on the one surface of the substrate and including patterns and grooves arranged alternately in the one direction, an outermost pattern among the patterns of the resistive layer being connected to the first internal electrode; and a protective layer disposed on the one surface of the substrate to cover the resistive layer, wherein the outermost pattern of the resistive layer has a first region in contact with the first internal electrode, and a second region extending, in the one direction, from the first region to one groove which is closest to the first internal electrode among the grooves, wherein the first region is disposed between the substrate and the first internal electrode, wherein the second region in the one direction has a length of 20 μm or more, wherein the protective layer comprises a first protective layer and a second protective layer, and wherein the first protective layer includes grooves corresponding to the grooves in the resistive layer.

15. The chip resistor component of claim 14, wherein a top surface of the first protective layer is higher than a top surface of the first internal electrode.

16. The chip resistor component of claim 14, wherein the first protective layer comprises a glass component.

17. The chip resistor component of claim 14, wherein the second protective layer comprises a resin component.

18. The chip resistor component of claim 14, wherein the second protective layer includes portions respectively disposed in the grooves in the first protective layer and the grooves in the resistive layer.

19. The chip resistor component of claim 14, wherein a thickness of the first region is reduced in the one direction towards the one side surface.

20. The chip resistor component of claim 14, wherein a thickness of the first region is less than a thickness of the second region.

* * * * *